US005168629A

United States Patent [19]

Willard

[11] Patent Number: 5,168,629

[45] Date of Patent: Dec. 8, 1992

[54] SCISSOR ASSEMBLY

[76] Inventor: Frank Willard, 11185 W. Bowles Pl., Littleton, Colo. 80127

[21] Appl. No.: 573,918

[22] Filed: Aug. 28, 1990

[51] Int. Cl.[5] ..... B26B 13/00; B26B 17/00; B26B 9/00

[52] U.S. Cl. ..... 30/231; 7/135; 30/254

[58] Field of Search ..... 30/135, 175, 254, 194, 30/291, 298, 134, 231, 232, 233, 236, 349; 7/132, 133, 131, 134, 135

[56] References Cited

U.S. PATENT DOCUMENTS

| | | | |
|---|---|---|---|
| 244,508 | 7/1881 | Woodward | 7/135 |
| 305,521 | 9/1884 | Kerner | 7/135 |
| 318,346 | 5/1885 | Branberg | 7/135 |
| 1,472,392 | 10/1923 | Harvey | 30/261 |
| 1,775,086 | 9/1930 | Bonehill | 30/134 |
| 2,387,032 | 10/1945 | Lowry | 30/175 |
| 2,741,841 | 4/1956 | Egeth | 30/135 |
| 3,323,209 | 4/1965 | Brill . | |
| 3,391,459 | 12/1968 | Rollo . | |
| 3,670,415 | 6/1972 | Rose | 30/349 |
| 3,711,947 | 1/1973 | Mason . | |
| 4,193,189 | 3/1980 | Marin | 30/349 |
| 4,633,587 | 1/1987 | Harrison . | |
| 4,651,761 | 3/1987 | Suen . | |
| 4,663,587 | 5/1987 | Sell . | |

*Primary Examiner*—Douglas D. Watts
*Assistant Examiner*—Paul M. Heyrana
*Attorney, Agent, or Firm*—Timothy J. Martin; Dana S. Rewoldt

[57] ABSTRACT

The present invention is a scissor assembly adapted to be in an open or closed position and to be manipulated by a user to cut a selected material. The scissors assembly includes a first scissors member and a second scissors member pivotally connect and biased into the open position. The first scissor member has a handle and a blade. The first handle is formed as an enlarged and elongated shaft sized to fit in a user's palm and be gripped by the fingers, the second scissor member likewise, has a handle and a blade. The second handle has a portion which defines a lever sized to be manipulated by the thumb when the first handle portion is fit in the user's palm and gripped by the user's fingers. In the preferred embodiment, the first handle is formed as a releasable container and the second handle is foreshortened relative to the first handle. In the alternative embodiments, the first handle is formed of implements such as a screw-driver, flashlight or pliers. The scissor assembly can also include a locking assembly to retain the closed position of the blades and a limit stop to limit the distance between the open position.

22 Claims, 3 Drawing Sheets

SCISSOR ASSEMBLY

FIELD OF THE INVENTION

The present invention relates generally to the field of implements for cutting and specifically to scissors which have handles for a secure grip on the instrument instead of finger loops. The present invention particularly concerns safety scissors for children and persons with impaired dexterity. Also, this invention relates to scissors having a handle that includes an auxiliary tool or container.

BACKGROUND OF THE INVENTION

Cutting implements and tools have been in use for hundreds of years for cutting hair, cloth, plants, paper, etc. Early on it was realized that cutting tools such as a scissors or shears where more efficient if the user only had to employ one hand to manipulate the tool. This left the other hand free to hold or guide the material during the cutting process. Thus, scissors were formed that had blades pivotally attached with handles having finger and thumb loops. The fingers and thumb of the hand were thus used to manipulate the blades into the open or cutting positions.

While the finger loop scissors are usable for many cutting projects, in certain situations they are unsuitable. For example, when accurate cutting is necessary, such as during emergency surgery, finger loop scissors can be unsuitable because they can be difficult to control due to the fact that the scissor is only being held by two fingers of one hand. When the user's fingers are covered with rubber gloves or slippery body fluids the user's fingers can cause the scissor to slip. Further, finger loop scissors can be difficult to remove from a doctor's fingers when another surgery tool is needed. Another instance in which finger loop scissors can be unsuitable is when the scissor is used to cut bulky material such as canvas, denim, etc. The grip of two scissor holding fingers is relatively weak and it is often impossible to manipulate the scissors to cut an even line. Further, the pressure on the fingers necessary for releasing the blades from the cutting position can be painful and cause blistering of the skin.

Furthermore, finger loop scissors are sometimes inappropriate because the user is not sufficiently dexterous to be able to perform the scissoring movement of the two fingers required to open and close the scissor blades. Examples, of such users can include persons with various muscular diseases, small children, arthritic person, and handicapped persons.

Often finger loop scissors are designed in such a manner that one loop fits the thumb and the other loop fits the fingers of the right hand, thus making the scissors uncomfortable for use by the left hand.

It may be appreciated that it would be desirable to have and there remains a need for a scissor which does not require dexterity of the fingers and thumb for operation but instead can be easily controlled by being held in the palm and thumb. There is further a need for a scissor that can be operated by using either the thumb or by applying a hand squeezing or gripping motion on handles to produce the cutting motion. Further there is a need for a scissor which can be held and operated with the right or left hand. Furthermore, there is a need for a scissor which is biased to return to the open position so that the operator is only required to use downward pressure to place the blades in the cutting position as the biasing means returns the blades to the open position; requiring less pressure strain on the muscles and skin of the scissoring fingers.

A scissors with these traits would be especially helpful when bulky material is cut, or when scissors are used often, such as in fabric stores or textile factories, or when a precisely controlled cut is required such as in surgery.

SUMMARY OF THE INVENTION

It is an object of the present invention to provide a scissors that can be manipulated with the palm and the thumb.

It is another object of the present invention to provide scissors having one enlarged handle that can be cupped in the palm of the hand and another handle that acts as a lever which can be manipulated by the thumb to effect cutting.

Yet another object of the present invention to provide a scissor with a tool or implement acting as a handle.

It is a further object of the present invention to provide a scissor handle that is a releasable container adapted to store various items such as thread, glue sticks, needles and a host of other items.

Still a different object of this invention is to provide a scissor that is easily operated without undue finger pressure because the blades spring back to the open position after being released from the cutting or closed position.

Another object of this invention is to provide a scissor assembly which can be readily manipulated by either left or right handed persons.

The present invention, therefore, specifically refers to a easily operated, easily held scissor assembly with at least one handle adapted to be a releasable container or to be a releasable implement or tool. In the broad form of the invention, then, the scissor assembly includes a first scissor member with a first handle portion and a first blade portion. The first blade portion extends forwardly from the first handle portion to terminate in a first distal tip. There is a second scissor member that has a second handle portion and a second blade portion. The second blade portion extends forwardly from the second handle portion to terminate in a second distal tip. The second handle portion defines a lever that is sized to be manipulated by the thumb. The first handle portion is an enlarged and elongated shaft that is sized to fit a user's palm and to be gripped therearound by the fingers. The first and second handle portions are in the held position when the thumb is positioned to manipulate the lever and the first handle portion is cradled in the palm and surrounded by the fingers of the user.

The first scissor member and the second scissor member are pivotally connected by a pivot structure. This pivotal connection is at a pivot location so that the first and second scissor members are movable between an open position and a closed or cutting position. In the open position the first and second scissor members are oriented in a transverse position to one another. In the closed or cutting position the first and second scissor member are alongside one another. Further the first and second scissor members are also biased by biasing means such that when the user is not exerting any pressure on the first and second handle portions the first and second scissor members will be biased into the open position.

The first and second scissor member can be formed to have a first and second cavity which form a chamber when the first and second scissor members are pivotally connected together. This chamber is adapted to receive the biasing means whereby the first and second scissor members are biased in the open position when there is no pressure placed on the first and second handles. Preferably, the shaft has a cylindrical shape, but it can be ergonomically constructed as well. If desired, the handle can be a releasable container for holding small items. It can also be a small tool or implement which acts as a handle such as a flashlight, or screw driver, wrench, or the like.

These and other objects of the present will become more readily appreciated and understood with an understanding that the following detailed description of the preferred embodiment when taken together with the accompanying drawings in which:

DETAILED DESCRIPTION OF THE EXEMPLARY EMBODIMENTS

Figure 1:
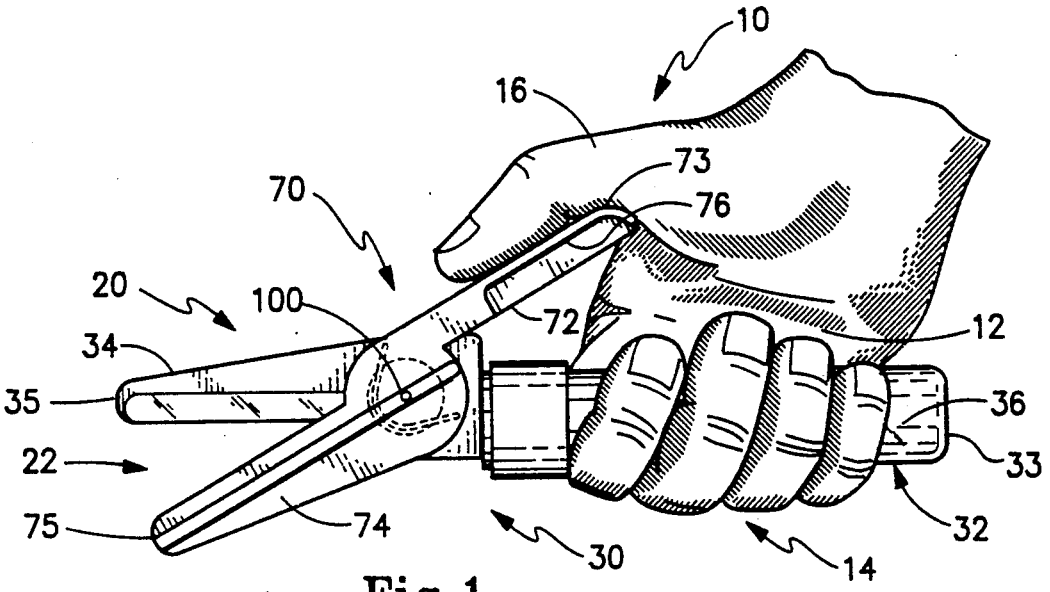
FIG. 1 is a side view in elevation of the scissor assembly according to one exemplary embodiment of the present invention shown being gripped in a user's hand.
Figure 2:
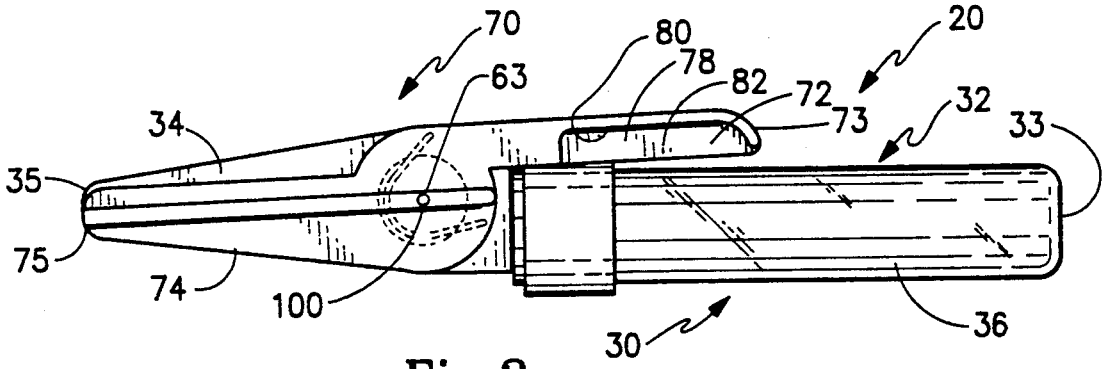
FIG. 2 is a side view in elevation of the scissor assembly shown in FIG. 1 but in the closed position.

The disclosure of the present invention is generally directed towards cutting devices, and particularly, the present invention is directed towards scissors. Thus, the present invention is described with respect to a scissors assembly, although ti should be understood that the present invention contemplates other cutting devices as well. Of particular concern of the present invention is the elimination of the standard scissor finger loops; thus, the scissor assembly according to the exemplary embodiment of the present invention is manually operated by the user's hand by means of a pair of handle portions. One handle portion is configured and sized to fit within the palm and four fingers of the hand of the user while the other handle portion is sized and oriented to be manipulated by the thumb.

For sake of illustration, then, an exemplary embodiment of the present invention is shown in FIGS. 1–5 and comprises a scissor assembly 20 adapted to be received in and manipulated by hand 10 of a user in order to cut a selected material. This scissor assembly 20 can be formed of plastic by injection molding although the cutting element is often formed of metal. As is shown in these figures, scissor assembly 20 includes a first scissor member 30 and a second scissor member 70 which are pivotally attached to one another about a pivot axis defining a pivot location 100. First scissor member 30 includes a first handle portion 32 and a first blade portion 34 rigidly connected to one another. Blade portion 34 extends forwardly of handle portion 32 to terminate in a forwardly distal tip 35, and handle portion 32 extends rearwardly to terminate in a free end 33. Similarly, second scissor member 70 includes a second handle portion 72, a second blade portion 74 rigidly connected to one another. Second blade portion 74 extends forwardly of second handle portion 72 to terminate in a forward distal tip 75 while second handle portion extends rearwardly to terminate in a second free end 73. First and second scissor members 30 and 70 are pivotally connected by a pivot structure at pivot location 100 so that they are movable between the open position shown in FIG. 1 and the closed position shown in FIG. 2. When scissor members 30, 70 are in the open position, first scissor member 30 and second scissor member 70 are oriented transversely to one another. Thus, an open region 22 is provided between open blade portions 34 and 74 so that material, such as paper, cloth or other material to be cut may be received between the blade portions. When the scissor members 30,70 are in the closed or cutting position, blade portions 34 and 74 are oriented alongside one another.

Figure 3:
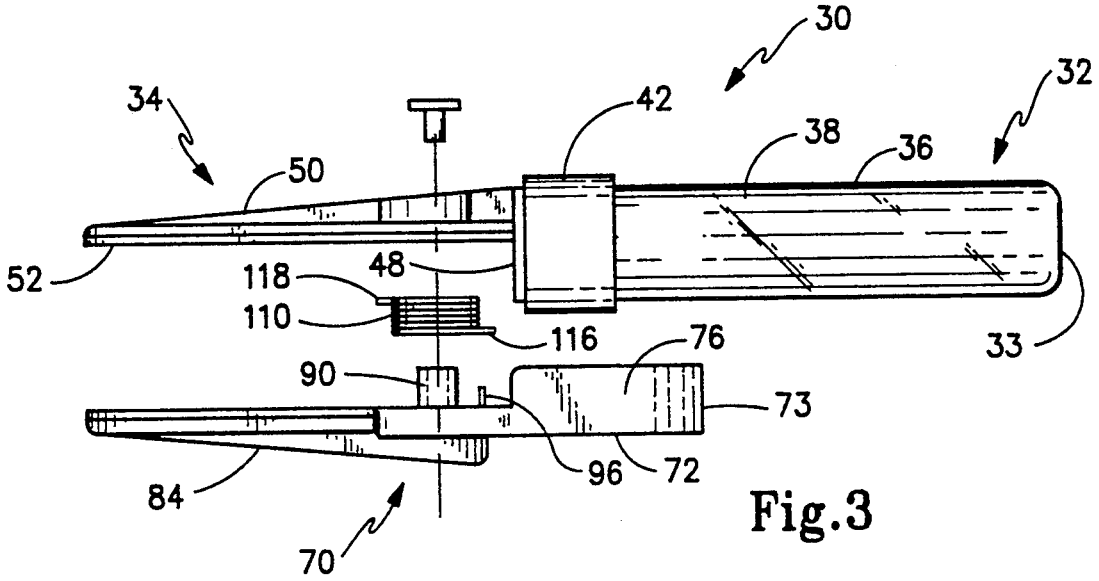
FIG. 3 is an exploded top plane view of the scissor assembly of FIGS. 1 and 2 showing the first and second scissor member.
Figure 4:
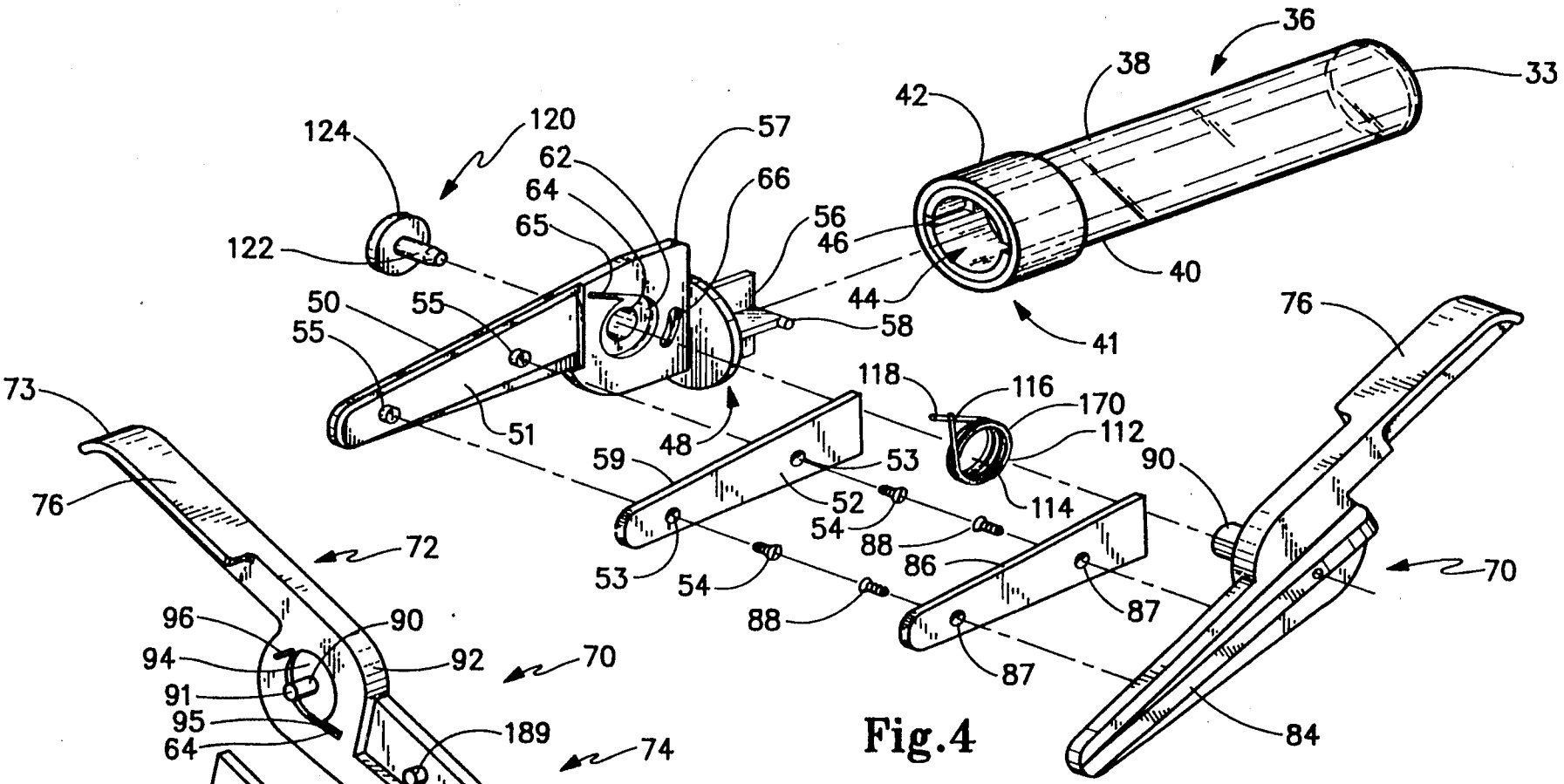
FIG. 4 is an exploded view in perspective of the scissor assembly shown in FIGS. 1–3.

With reference to FIGS. 1–5, it may be seen that first handle portion 30 is formed to include an enlarged and elongated shaft 36 sized to fit within the scissor operator's palm 12 and to be gripped therearound by the fingers 14. Preferably, shaft 36 is defined by a container 38 having a surrounding sidewall 40 with free end 33 being closed, as is shown in FIG. 4. Shaft 36 has an open end 41 with an enlarged head 42 and an interior 44 with the interior side of enlarged head 42 being provided with a pair of L-shaped grooves 46. Enlarged head 42 matably receives a releasable mounting collar 48 so that container 38 may be releasably locked on the blade portion 34, as described more thoroughly below.

Blade portion 34 of first scissor member 30 has a blade support 50 with an inner surface 51 to which is releasably mounted a cutting element 52. To this end, cutting element 52 has a pair of countersunk bores 53 adapted to receive suitable screws 54 threadably received in threaded holes 55 in blade 50.

Mounting collar 48 is formed integrally with blade 50 and includes a web structure 56 having a pair of outwardly projecting prongs such as prong 58, shown in FIG. 4, which lockably engage L-shaped slots 46 of interior of enlarged head 42 of shank 36.

Second scissor member 70 is shown in FIGS. 1–5, includes handle portion 72 and blade portion 74, as noted above. Handle portion 72 extends rearwardly of blade portion 74 and is formed as an elongated plate or platform 76 which terminates in an arcuate free end 73. Platform 76 is strengthened by a web 82 extending longitudinally of platform 76. Platform 76 thus defines a lever which is foreshortened relative to first handle portion 32 and is shaped such that thumb 16 of the user's hand, can curve easily round free end 73 and rest longitudinally on platform 76, as discussed in greater detail below. Blade portion 74 is structured somewhat similarly to blade portion 34 and includes a blade 84, an inner surface 81, and a cutting element 86 that is releasably mounted on blade 84 by means of a pair of screws 88 which extend through countersunk holes 87 to be threadably received by threaded holes 489 (in FIG. 8) in blade 84.

Figure 5:
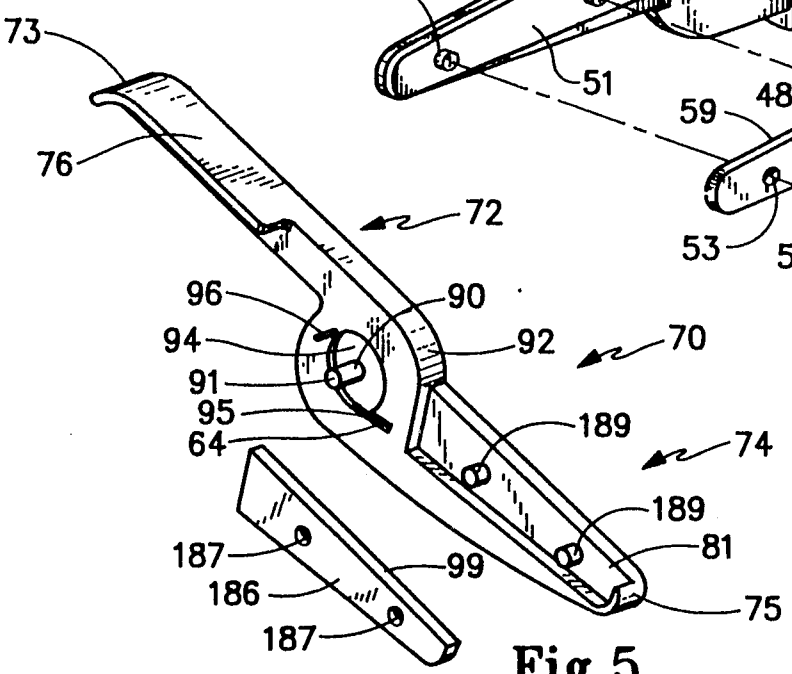
FIG. 5 is a side view in elevation of the second scissor member showing the inside spring mounting and limit stop structure.
Figure 7:
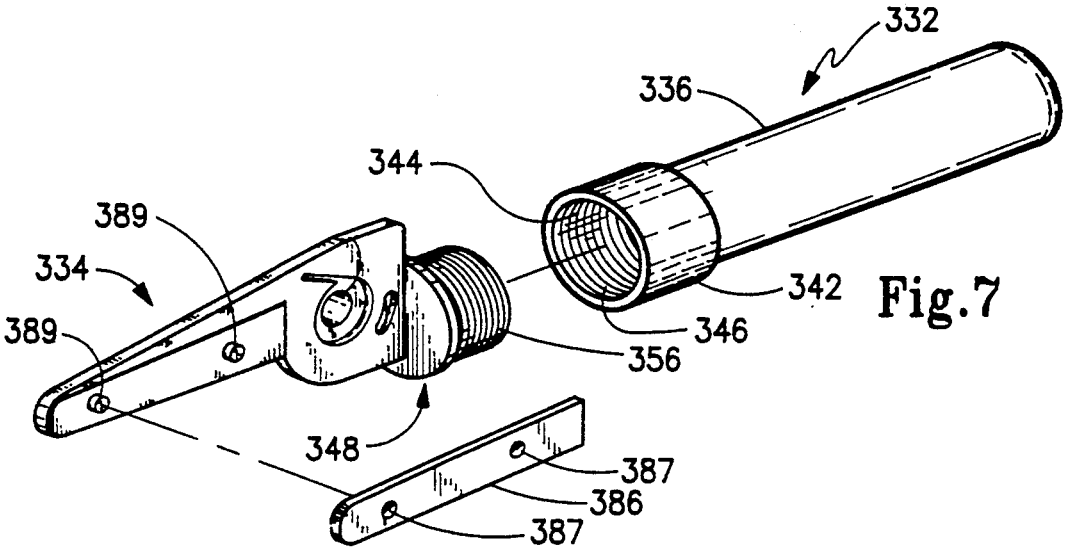
FIG. 7 is an exploded view in perspective showing a second alternate embodiment of the present invention.

Alternatively, as shown in FIG. 5 and FIG. 7 the blade portions 74,334 can be formed with projecting posts 189,389 instead of threaded bores. The cutting element 186,386 are formed with holes 187,387 operative to push fit releasably onto the projecting posts 189,389, in such a manner that cutting elements 186,386 are releasably mounted to blades 74 and 334.

AS noted above, first and second scissor members 30 and 70 are pivotally secured to one another so that they may be manually operated to move between the open and closed positions. To this end, as is shown in FIG. 3-5, scissor member 70 includes a post 90 extending from central section 92 thereof. Post 90 has an axial bore 91 formed therein and is adapted to be received in a hole 62 formed in central section 62 of blade portion 34. As is seen in FIGS. 4 and 5, post 90 is surrounded by a toroidal cavity 94 which includes a tang receiving recess 95 as an extension thereof. Similarly, hole 62 is surrounded by a cavity 64 including a tang receiving recess 65 formed as an extension thereof. A coil spring 110 includes a central section 112 that has an opening 114 adapted to extend around post 90 and includes tangs 116 and 118 that are respectively adapted to fit recesses 95 and 65. Limit stop means are provided, also, in the form of a second smaller post 96 which extends from central section 92 of scissor member 70 which is oriented and sized to be received in a slotted recess 66 formed in central section 57.

The interrelationship of the elements of the scissor assembly 20 may now be more fully understood. First, it should be understood that cutting elements 52 and 86 are each respectively mounted on blades 50,84 and blade portion 34 is mounted to second scissor member 70. To this end, coil spring 110 si telescopically received on post 90 so that tang 116 is oriented in a recess 95 and with central section 112 being received in cavity 64. Post 90 is then inserted into hole 62 so that central section 112 of spring 110 is also received in cavity 64 with tang 118 being located in tang receiving recess 65. During the assembly of the elements, post 96 is inserted into post receiving slot 66. And cavity 64 in the first scissor member 30 and cavity 64 in the second scissor member 70 form an enclosed chamber 63 (shown in FIG. 2) which totally encloses coil spring 110 such that it is safely hidden from a small child which may be using the scissor assembly. This assembly is then completed by means of connecting pin 120 which includes a shank 122 and an enlarged head 124. Shank 122 extends through hole 62 and engages bore 91 in post 90 so as to hold blade portion 34 onto scissor member 70. Shank 36 is then mounted on collar 48 by engaging webs 56 and extension 58 with L-shaped slots 46 and enlarged head 42 thus forming handle portion 32. It should be understood, that in this assembly, spring 110 operates to bias first and second scissor members 30,70 into the open position so that, after they are forcibly moved to the closed position, removal of the closing force allows blade portions 34,74 to open.

Turning again to FIG. 1, it may be seen that operation of this assembly may readily be accomplished by the hand 10 of the user without the need for traditional finger loops. As is shown in FIG. 1, shank 36 is readily received by palm 12 and fingers 14 with foreshortened handle portion 72, with arcuate free end 73 sized to that thumb 16 may extend over free end 73 to lie longitudinally along platform 76. When pressure is applied by thumb 16 to second handle portion 72, the first and second blade portions 34,74, can be closed against the biasing force of spring 110 which is locked into position by tangs 116,118 and recesses 65,95. Operation of scissor assembly 20, thus takes less dexterity than is often needed with the traditional finger loop scissors. Further, due to the ability to cradle shaft 36 of first handle portion 32 in the palm and fingers, the scissor assembly 20 is very useful for those persons who otherwise have problems using finger loop style scissors, such as children, elderly or handicapped individuals. Further, in those situations where scissors with finger loops either have a tendency to slip as a result of the user's wearing rubber glove or other external factors such as the presence of fluids on the scissors, the present structure has distinct advantages. Limit stop post 96 and its engagement in slot 66, prevents hyperextension of the blade portions 34,74, beyond the desired open position. By providing releasable cutting elements 52 and 86, another advantage is found since the cutting elements may be removed from the scissor assembly 20 to be removed and stored separately from the scissor assembly 20. This allows an additional degree of protection against inadvertent cuts or other dangers caused by the sharp or attack edges 59,99. This removability also allows for a higher degree of sterilization of the cutting elements 52,86, when this type of scissor assembly is used in a surgical setting.

Figure 6:
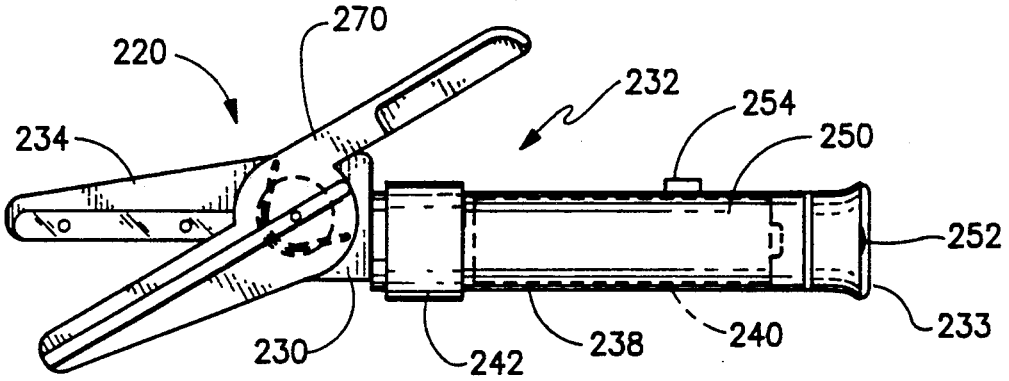
FIG. 6 is a side view in elevation showing a first alternate embodiment of the present invention.

The container provided by removable shank 36 having hollow interior 44 may be used to store a variety of items, depending upon who the intended user for scissor assembly 20. These items can include such things as band-aids, glue sticks, thread, needles, pins, candy, whistles, small pencils, pencil sharpeners, staplers, to name a few. As an alternate embodiment to this removable container, it is possible that first handle portion 32 can be formed as an auxiliary implement to the scissors provided by blade portions 34,74. Thus is as shown in FIG. 6, for example, a scissor assembly 220 is shown which is formed by a first scissor member 230 and a second scissor member 270. Second scissor member 270 is constructed identically to scissor member 70, and scissor member 230 is constructed the same as scissor member 30 with the exception that handle portion 232 is formed as an auxiliary implement defined by a flashlight 250. Flashlight 250 is formed of a housing having a sidewall 238 which houses a battery 240 (shown in phantom) and suitable electronics to operate light 252. Free end 233 of handle portion 232 thus forms a lens for flashlight 250, and flashlight 250 is mounted to blade portion 234 of cutter member 230 by means of an enlarged head 242 that is configured similarly to enlarged 42 of scissor assembly 20. A switch 254 is provided to operate flashlight 250. It should be understood that flashlight 250 is only one of a variety of implements which can form handle portion 232 and that it is contemplated that this handle portion 232 may be formed by other implements such as a knife, a flashlight, a pliers, a screwdriver, a small hammer, a wrench, a key ring, a can opener, needle threader, a writing instrument, a stapler, an eating utensil, a corkscrew and such other and various implements as may be apparent to the ordinarily skilled person in this field of invention.

FIG. 7 shows an alternate structure to mounting collar 48 and enlarged head 42. In FIG. 7, handle portion 332 is formed of a similar hollow shank 336 with this shank having an enlarged head 342 and an open interior 344. The inside of enlarged head 342 is threaded, however, by means of threads 346 which replace L-shaped grooves 46 in the embodiment first discussed above. To compliment these threads, blade portion 334 of this assembly includes a mounting collar 348 that is provided with threaded section 356 so that enlarged head 342 may be screw fit thereon. While this assembly does not allow the quick attachment and quick release of the shank 336, it does provide for a more secure attachment when employed.

Figure 8:
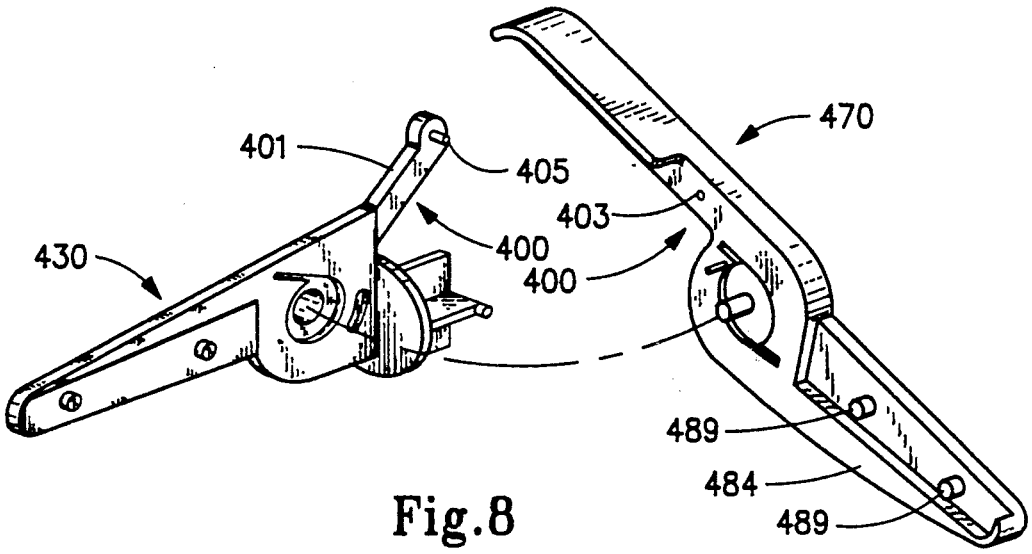
FIG. 8 is an exploded view in perspective showing a locking assembly.

FIG. 8 shows an optional locking assembly 400 located in part on the first scissor member and in part on the second scissor member operative to lockably secure the scissor members 430, 470 when in the closed position. The locking assembly 400 includes a locking lever 401 hingedly attached to the first scissor member 430 operative to engage the second scissor member 470 which defines a registration hole 403. Locking lever 401 is laterally movable relative to the first scissor member 430 such that when the first and second scissor members 430,470 are in the closed position the locking lever 401 can be positioned such that locking post 405 cooperatively engages the registration hole 403, thus securing the first and second scissor members 430,470 in the closed position for easy storage or for safety purposes. It should be understood that the locking lever 401 and the registration hole 403 can be formed on either the first or the second scissor members 430,470 and that other various locking assembly are within the scope of this invention.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A scissor assembly adapted to be manipulated by a user to cut a selected material comprising:

a first scissor member including a first handle portion and a first blade portion extending forwardly of said first handle portion to terminate at a first distal tip, said first handle portion formed as an enlarged and elongated shaft sized to fit in a user's palm and be gripped therearound in a held position by the fingers;

a second scissor member including a second handle portion and a second blade portion extending forwardly of said second handle portion to terminate at a second distal tip, said second handle portion being formed as a relatively flat platform having an upper surface, a lower surface and a thickness therebetween, said platform having a length in a longitudinal direction and a width transverse to the longitudinal direction that is greater than the thickness thereof so that the width of said platform projects laterally of the longitudinal direction to define a plate-like lever sized to be manipulated by the thumb when positioned on the upper surface of said platform and when the first handle portion is fit into the user's palm and gripped by the user's fingers;

a pivot means for pivotally connecting said first and second scissor members at a pivot location whereby said first and second scissor members are movable between an open position wherein said first and second scissor members are orientated transversely to each other whereby said material may be received therebetween, and a closed position wherein said first and second scissor members are oriented alongside one another, said second handle being oriented so that it is at an acute angle to the first handle when in the open position and moves into an orientation laterally adjacent said elongated shaft when in the closed position; and biasing means for biasing said first and second scissor members toward the open position.

2. A scissor assembly in accordance with claim 1 wherein said lever extends rearwardly of said second blade portion to terminate at a second free end, said second free end being arcuate to provide a curved surface so that said thumb can easily curve over said second free end to rest longitudinally on said lever.

3. A scissor assembly according to claim 1 wherein said first handle portion is formed as a releasable container operative to receive items for storage.

4. A scissors according to claim 3 wherein said container includes a closed free end, a surrounding sidewall and an open enlarged head located adjacent said pivotal location, said open head adapted to lockably engage a handle mounting structure on said first scissor member proximate the pivot location.

5. A scissors assembly according to claim 4 wherein said open head includes an interior portion adapted to lockably engage said handle mounting structure.

6. A scissor assembly according to claim 5 wherein said handle mounting structure includes outwardly projecting extensions that releasably engage L-shaped grooves located in said open head.

7. A scissor assembly according to claim 6 wherein said container is cylindrical.

8. A scissor assembly according to claim 1 wherein said first handle portion is formed as an auxiliary implement.

9. A scissor assembly according to claim 8 wherein said auxiliary implement selected from a group consisting of a knife, a flashlight, a plier, a screwdriver, a hammer, a wrench, a key ring, a can opener, a needle threader, a writing instrument, a stapler, an eating utensil and a cork screw.

10. A scissors assembly adapted to be manipulated by the user's thumb and palm and fingers of one hand for cutting a selected material, comprising:

a first scissor member including a first handle portion and a first blade portion having a first inner surface, said first blade portion extending forwardly of said first handle portion to terminate at a first distal tip;

a second scissor member including a second handle portion and a second blade portion having a second inner surface, said second blade portion extending forwardly of said second handle portion to terminate at a second distal tip, said second handle portion formed as a lever;

a pivotal means for pivotally connecting said first and second scissor members at a pivot location whereby said first inner surface and second inner surface are oriented to face one another, and said first and second scissor members are movable between an open position wherein said first and second scissor members are oriented transversely to each other and a closed position wherein said first and second scissor members are oriented alongside one another;

limiting stop means located on said first and second inner surfaces for limiting the spaced apart orientation between said first scissor member and said second scissor member in the open position;

biasing means for biasing said first and second scissor members toward the open position; and said first scissor member having a first cavity at the pivot location and said second scissor member having a second cavity opposed to said first cavity at the pivot location, said first cavity and second cavity registering with one another when said first and second scissor members are pivotally connected to form a chamber operative to receive said biasing means.

11. A scissor assembly in accordance with claim 10 wherein said biasing means includes a coil spring having a coiled central section and first and second tangs extending outwardly from said coiled section, said first cavity having a first tang receiving recess extending therefrom and said second cavity having a second tang receiving recess extending therefrom, said chamber operative to receive said coiled central section with said first and second tang receiving recesses receiving said first and second tangs, respectively.

12. A scissor assembly in accordance with claim 11 wherein said pivot means includes a post on one of said scissor members, said chamber being toroidal in shape, said coiled central section having a central opening therethrough so that said coiled central section may telescopically receive said post.

13. A scissor assembly in accordance with claim 12 wherein another one of said scissor members has a post receiving bore operative to engage said post when said first and second scissor members are connected together.

14. A scissor assembly in accordance with claim 13 wherein said post has an axial bore and another one of said scissor members has a hole therein, and including a connecting pin formed with an enlarged head and a shaft whereby said shaft may extend through the hole to mountably engage the axial bores.

15. A scissor assembly adapted to be held by a user in one hand by the palm and fingers and operated by the thumb to cut materials, comprising:

a first scissor member;

a second scissor member pivotally connected to said first scissor member at a common pivot location;

said first scissor member having a first blade portion located forwardly of said pivot location and a first handle portion located rearwardly of said pivot locations, said first handle portion formed adjacent said pivot location at least in part as a releasable container portion having an open enlarged head located proximate said pivot location, said open head having means to lockably engage a handle mounting structure on said first scissor member and a first free end opposite said one container end adapted to be cradles in the user's palm; and said second scissor member including a second blade portion located forwardly of said pivot location, and including a second handle portion located rearwardly of said pivot location, said second handle portion sized to be manipulated by the user's thumb placed longitudinally thereon.

16. A scissor assembly accordingly to claim 15 wherein said container has a surrounding sidewall that defines an open interior, said surrounding sidewall being is sized to be cradled by the user's palm and fingers.

17. A scissor assembly according to claim 16 wherein said open end includes an enlarged head having an interior side adapted for releasably engaging said first scissor member.

18. A scissor assembly according to claim 16 wherein said open end includes threads for matably engaging said first scissor member.

19. A scissor assembly according to claim 17 wherein said first scissor member includes outwardly projecting extensions that lockably engage locking means in said interior side of said enlarged head located in said open end.

20. A scissor assembly according to claim 19 wherein said locking means include L-shaped grooves in said interior side of said enlarged head adapted to receive said outwardly projecting extensions.

21. A scissor assembly according to claim 15 wherein said first and second blade portions each are provided with a removable cutting element.

22. A scissor assembly according to claim 15 wherein said first scissor member and said second scissor member include a locking assembly operative to lockably secure the first scissor member and the second scissor member in the closed position.

* * * * *